US010276905B2

(12) United States Patent
Li et al.

(10) Patent No.: US 10,276,905 B2
(45) Date of Patent: Apr. 30, 2019

(54) NON-CONTACT FREQUENCY AUTOMATIC TUNING FILTER WITH ANTILEAKAGE CHAMBER

(71) Applicant: UNIVERSAL MICROWAVE TECHNOLOGY, INC., Keelung (TW)

(72) Inventors: Chien-Chih Li, Taipei (TW); Jen-Ti Peng, Keelung (TW); Shih-Gong Ciou, Taipei (TW); Cheng-Lung Wu, Keelung (TW); Ruei-Yang Syu, Chiayi County (TW); Jui-En Fan, New Taipei (TW)

( * ) Notice: Subject to any disclaimer, the term of this patent is extended or adjusted under 35 U.S.C. 154(b) by 65 days.

(21) Appl. No.: 15/646,231

(22) Filed: Jul. 11, 2017

(65) Prior Publication Data

US 2019/0020090 A1 Jan. 17, 2019

(51) Int. Cl.
*H01P 1/06* (2006.01)
*H01P 1/208* (2006.01)

(52) U.S. Cl.
CPC ..... *H01P 1/2086* (2013.01); *H01P 1/06* (2013.01)

(58) Field of Classification Search
CPC ..... H01P 1/2086; H01P 1/06
USPC ..... 333/209
See application file for complete search history.

(56) References Cited

U.S. PATENT DOCUMENTS 9,887,445 B2 * 2/2018 Chen ..... H01P 1/208

* cited by examiner

*Primary Examiner* — Robert J Pascal
*Assistant Examiner* — Kimberly E Glenn

(57) ABSTRACT

A non-contact frequency automatic tuning filter with an antileakage chamber includes a first casing with a first cavity formed at a first opening of the first casing, a moving part, and a second cavity. The second cavity has a second casing, a chamber formed in the second casing, and second and third openings penetrating through the second casing. The moving part is plugged from the third opening into the first cavity or from the third opening into a space between the third opening and the first cavity. The second opening proximate to the moving part constitutes a part of the chamber. The second casing has a spacing portion proximate to the moving part for separating the moving part and chamber. The first and second casings are not in contact with the moving part. The invention can prevent leakage of electromagnetic waves and unstable frequency shifting.

8 Claims, 5 Drawing Sheets

NON-CONTACT FREQUENCY AUTOMATIC TUNING FILTER WITH ANTILEAKAGE CHAMBER

BACKGROUND OF THE INVENTION

Field of the Invention

The present invention relates to the technical field of automatic tuning filters, in particular to a non-contact frequency automatic tuning filter with an antileakage chamber where the center frequency and bandwidth of the filter can be changed by adjusting a moving part.

Description of Related Art

In general, a conventional frequency automatic tuning filter just includes a first casing, a first cavity formed on a first opening of the first casing, and a moving part. The moving part is plugged into the first opening. When the moving part and the first casing are in contact with each other, friction will be produced between the moving part and the first casing. As a result, the center frequency of the filter becomes unstable in the shifting process. If an interference is occurred, or a partial deformation and/or gap is formed at an unexpected position resulted from the friction between the moving part and the first casing, or a poor contact caused by low manufacturing precision, a large amount of electromagnetic waves in the first cavity will be dispersed to the exterior of the conventional frequency automatic tuning filter, and a correct transmission of the electromagnetic waves will be affected seriously.

SUMMARY OF THE INVENTION

Therefore, it is a primary objective of the present invention to provide a non-contact frequency automatic tuning filter with an antileakage chamber comprising a first casing having a first cavity formed at a first opening of the first casing, a first moving part, and a second cavity, and the second cavity has a second casing, a first chamber formed in the second casing, and a second opening and a third opening penetrating through the second casing, and the first moving part is plugged from the third opening into the first cavity or plugged from the third opening into a space between the third opening and the first cavity, and the portion of the second casing proximate to the plugged first moving part is configured into the shape of the first moving part, and the second opening is proximate to the first moving part and constitutes a part of the first chamber, and the second casing has a spacing portion disposed near the first moving part and provided for separating the first moving part and the first chamber, and the first casing and the second casing are not in contact with the first moving part.

The non-contact frequency automatic tuning filter with an antileakage chamber of the present invention further comprises a driving unit for adjusting an insertion depth of the first moving part.

In the non-contact frequency automatic tuning filter with an antileakage chamber of the present invention, both of the first cavity and the first moving part come with a plural quantity, and at least two of the first cavities are communicated with each other.

The non-contact frequency automatic tuning filter with an antileakage chamber of the present invention further comprises a linking part coupled to the first moving part of each respective first cavity to adjust the insertion depth of each first moving part.

In the non-contact frequency automatic tuning filter with an antileakage chamber of the present invention, the second cavities of different first cavities are not communicated with one another.

The non-contact frequency automatic tuning filter with an antileakage chamber of the present invention further comprises a second moving part and a fifth opening, and at least two of the first cavities are communicated with each other through a first cavity channel, and the total number of the first moving parts and the second moving parts is equal to the total number of the third openings and the fifth openings, and the second moving part and the fifth opening are configured to be corresponsive to the first cavity channel, and provided for the second moving part to be plugged from the fifth opening into the first cavity channel or plugged from the fifth opening into a space between the fifth opening and the first cavity channel.

In the non-contact frequency automatic tuning filter with an antileakage chamber of the present invention, the first casing has a first part and a second part disposed opposite to each other, and the second cavity is disposed at the first part and further includes a third moving part, a third casing disposed at the second part, a second chamber formed in the third casing, and a third cavity penetrating through the sixth opening of the third casing, the third moving part and the sixth opening are configured to be corresponsive to the first cavity channel, and provided for the third moving part to be plugged from the sixth opening into the first cavity channel or plugged from the sixth opening into a space between the sixth opening and the first cavity channel.

In the non-contact frequency automatic tuning filter with an antileakage chamber of the present invention, the non-contact frequency automatic tuning filter with an antileakage chamber achieves an automatic tuning of the center frequency or bandwidth of the filter by the first cavity and the first moving part of a different insertion depth.

Compared with the prior art, the present invention provides a structure having an antileakage chamber, so that a spacing is produced between the moving part and the filter body to stabilize the movement of the moving part without causing a leakage of a large quantity of signals.

DESCRIPTION OF THE INVENTION

The aforementioned and other objects, characteristics and advantages of the present invention will become apparent with the detailed description of the preferred embodiments and the illustration of related drawings as follows.

Figure 1:
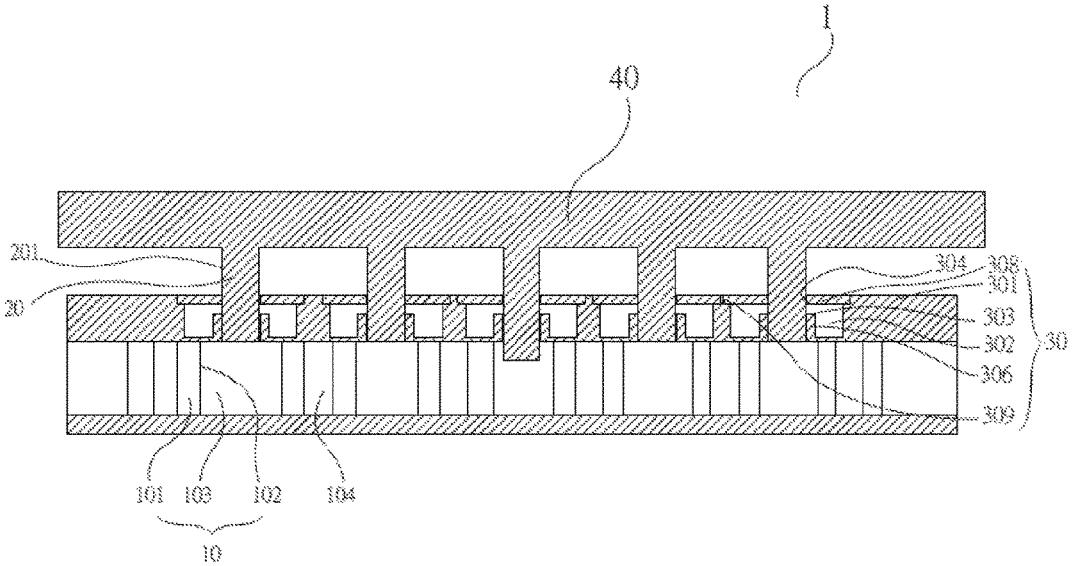
FIG. 1 is a cross-sectional view of a non-contact frequency automatic tuning filter with an antileakage chamber in accordance with the present invention.
Figure 2:
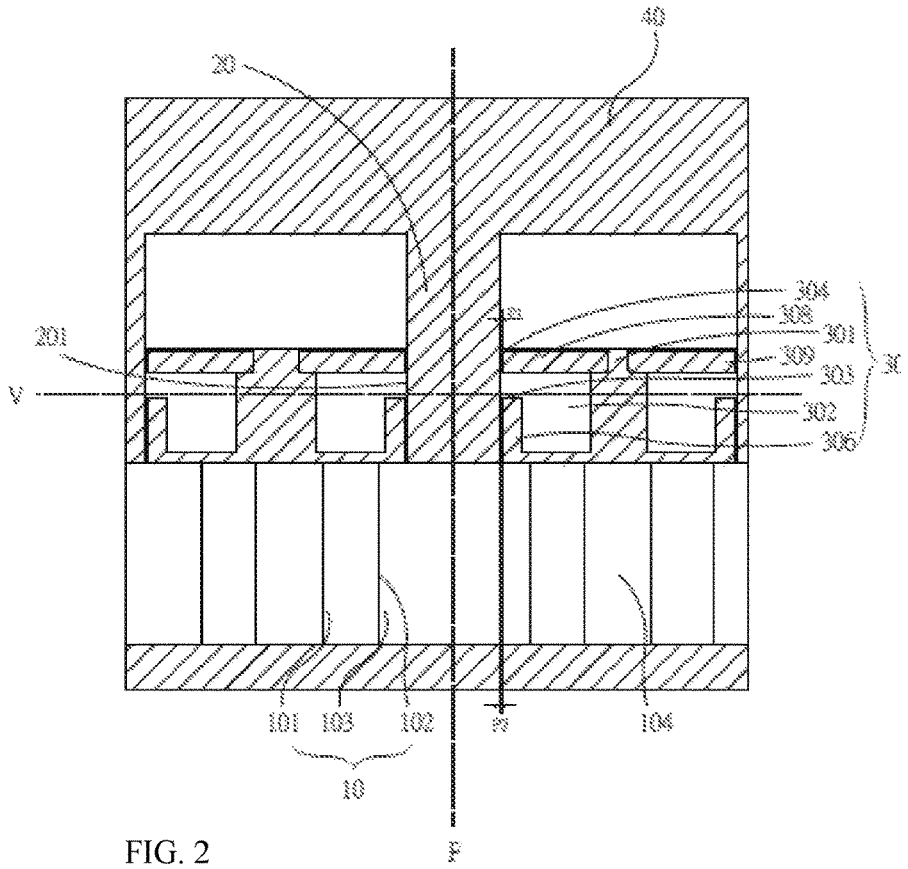
FIG. 2 is a partial blowup view of FIG. 1.
Figure 3A:
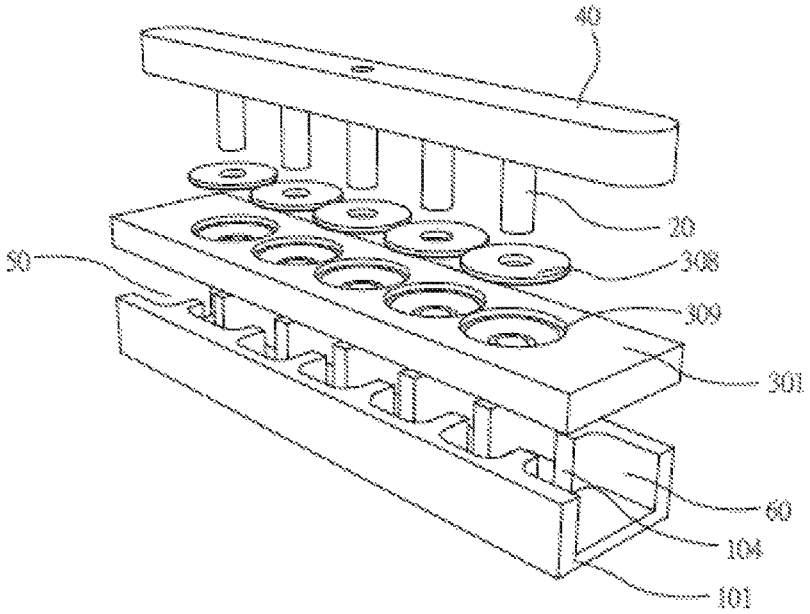
FIGS. 3A and 3B are exploded views of a non-contact frequency automatic tuning filter with an antileakage chamber in accordance with two preferred embodiments of the present invention respectively.
Figure 3B:
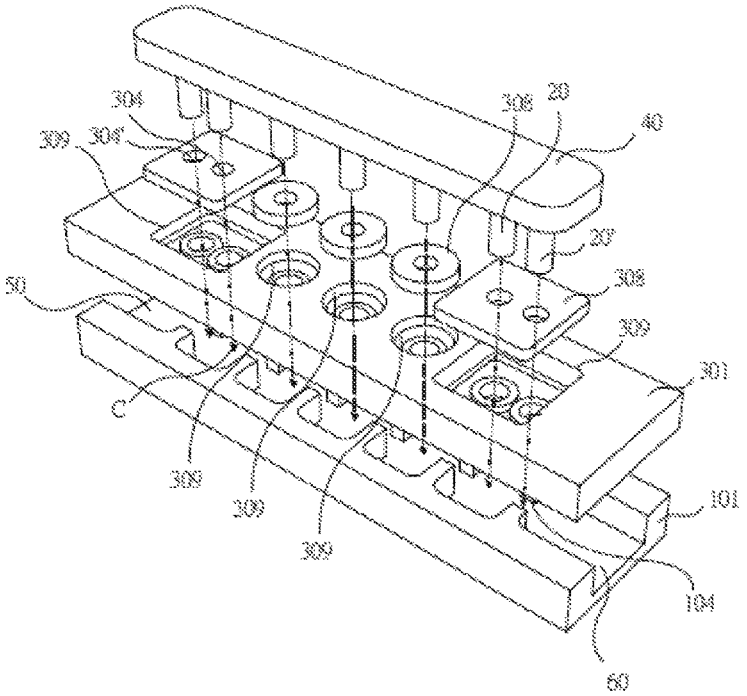

With reference to FIG. 1 for the cross-sectional view of a non-contact frequency automatic tuning filter with an antileakage chamber in accordance with a preferred embodiment of the present invention, FIG. 2 for the partial exploded view of FIG. 1, and FIGS. 3A and 3B for the exploded views of a non-contact frequency automatic tuning filter with an antileakage chamber in accordance with two preferred embodiments of the present invention respectively, the non-contact frequency automatic tuning filter with an antileakage chamber 1 comprises a first cavity 10, a first moving part 20, and a second cavity 30.

The single first cavity 10 has a first casing 101 and a first opening 102 formed on the first casing 101. The first opening 102 penetrates through a portion of the first casing 101 and forms a resonant cavity 103 when the first moving part 20 is plugged, so that the transmitted electromagnetic waves will not be dispersed, and the electromagnetic wave can be transmitted effectively. Provided that both of the first cavity 10 and the first moving part 20 come with a plural quantity, at least two of the first cavities 10 are communicated with each other as shown in FIGS. 1 to 3A and 3B, a first cavity channel 104 is formed between two adjacent first cavities 10 and provided for transmitting the electromagnetic waves along a series of first cavities 10. Specifically, as shown in FIGS. 3A and 3B, the electromagnetic waves entering from an input end 50 into a series of first cavities 10 and first cavity channels 104 are transmitted to an output end 60.

The single second cavity 30 is configured for a respective single first cavity 10. If the first cavity 10 comes with a plural quantity, the quantity of second cavities 30 will be equal to the quantity of first cavities 10, and the second cavities 30 of different respective first cavities 10 are not communicated with one another. When a single first cavity 10 is configured for a respective single second cavity 30, the second cavity 30 has a second casing 301, a first chamber 302 formed in the second casing 301, and a second opening 303 and a third opening 304 penetrating through the second casing 301, and the third opening 304 is configured to be corresponsive to the first opening 102 and provided for the first moving part 20 to be plugged from the third opening 304 into the first cavity 10 (as shown by the middle of FIG. 1) or plugged from the third opening 304 into a space between the third opening 304 and the first cavity 10, and the portion of the second casing 301 proximate to the plugged first moving part 20 is configured into the shape of the first moving part 20. For example, an acute angle or a right angle is included between an extension line of the normal V of the second opening 303 as shown in FIG. 2 and an extension line of the path F of plugging the first moving part 20 from the third opening 304 into the first opening 102 to fit the irregular shape of the first moving part 20. Specifically, a right angle is included between the extension line of the normal V of the second opening 303 and a side surface 201 of the first moving part 20. The second opening 303 is disposed proximate to the first moving part 20 and constitutes a part of the first chamber 302, and the second casing 301 has a spacing portion 306 disposed proximate to the first moving part 20 and provided for separating the first moving part 20 and the first chamber 302. With the design of the present invention, when the first moving part 20 is moving, the electromagnetic wave of the first cavity 10 may not pass through a space between the first moving part 20 and the third opening 304 to prevent a large quantity of electromagnetic waves from dispersing to the outside of the non-contact frequency automatic tuning filter with an antileakage chamber 1 by means of the gap formed by the movement of the first moving part 20, and a small quantity of electromagnetic waves is transmitted through the second opening 303 to the second cavity 30, so as to maximize the effect of transmitting the electromagnetic waves correctly.

As shown on both left and right sides of FIG. 3B, at least two of the first cavities 10 are communicated with each other through the first cavity channel 104, and the non-contact frequency automatic tuning filter with an antileakage chamber 1 of the present invention further comprises a second moving part 20' and a fifth opening 304', and the total number of the first moving parts 20 and second moving parts 20' is equal to the total number of the third openings 304 and fifth openings 304', and the second moving part 20' and the fifth opening 304' are configured to be corresponsive to the first cavity channel 104 and provided for the second moving part 20' to be plugged along an insertion direction C as shown in FIG. 3B from the fifth opening 304' into the first cavity channel 104, or plugged from the fifth opening 304' into a space between the fifth opening 304' and the first cavity channel 104.

It is noteworthy that the second moving part 20' plugged from the fifth opening 304' into the first cavity channel 104 or plugged from the fifth opening 304' into a space between the fifth opening 304' and the first cavity channel 104 as shown on the left and right sides of FIG. 3B may be designed as the middle first cavity channel 104 among a series of the first cavity channels 104 or any other first cavity channel 104, and it is not necessarily designed as the first cavity channels 104 at the leftmost and rightmost edges.

The second cavity 30 has a stepped flange 309 formed on the second casing 301 and disposed at a position away from the first cavity 10 and provided for a cover 308 having the third opening 304 to be coupled to the second casing 301 to jointly form the second casing 301. By 3D printing, the second casing 301 may be formed integrally, and the cover 308 may be in a circular shape, an oval shape, a polygonal shape or any combination of the above.

In the present invention, the second casing 301 and the first moving part 20 are not in contact with each other as shown in FIG. 2 to prevent the second casing 301 and the first moving part 20 from moving to unexpected positions resulted from the friction produced between the second casing 301 and the first moving part 20 while the first moving part 20 is moving, or preventing unstable phenomenon caused by partial deformation and/or gap formed during the process of shifting the center frequency of the filter. Specifically, the second casing 301 has a first spacing P1 formed between the third opening 304 and the plugged first moving part 20.

Similarly, a second spacing P2 is formed between the spacing portion 306 of the second casing 301 and the plugged first moving part 20, wherein the first spacing P1 may be the same as the second spacing P2, and the spacing portion 306 is provided for assisting the first moving part 20 to maintain its stability while moving, so as to prevent any unstable phenomenon occurred while the first moving part 20 is moving. Although a large quantity of electromagnetic waves is dispersed from the space between the second casing 301 and the plugged first moving part 20 to the spacing outside the non-contact frequency automatic tuning filter with an antileakage chamber 1, the filter of the present invention adopts the design of guiding a small quantity of the leaked electromagnetic waves through the second opening 303 into the first chamber 302 and the non-contact design of the second casing 301 and the first moving part 20 to prevent any unstable phenomenon occurred during the process of shifting the center frequency of the filter and resulted from the friction produced between the second casing 301 and the first moving part 20, so that a large quantity of electromagnetic waves will not be dispersed to the outside of the non-contact frequency automatic tuning filter with an antileakage chamber 1, so as to maximize the effect of transmitting the electromagnetic waves correctly.

It is noteworthy that the second cavity 30 configured to be corresponsive to the first cavity channel 104 further includes a structure similar to that having the first moving part 20 plugged into the second opening 303 of the second cavity 30 and the spacing portion 306. In other words, such structure comprises a fourth opening 303' and a spacing portion 306 configured to be corresponsive to the fourth opening 303' as shown in FIG. 4A.

Similarly, the first casing 101 and the first moving part 20 may not in contact with each other to prevent any unstable phenomenon occurred during the process of shifting the center frequency of the filter and resulted from the friction produced between the first casing 101 and the first moving part 20.

The non-contact frequency automatic tuning filter with an antileakage chamber 1 of the present invention further comprises a driving unit for adjusting an insertion depth of the first moving part 20 to achieve a frequency offset caused by frequency disturbance. The driving unit may be operated with the linear moving component and the electric control equipment to move the first moving part 20 up and down with respect to the first cavity 10. In addition, the non-contact frequency automatic tuning filter with an antileakage chamber 1 of the present invention further comprises a linking part 40 configured to each respective first moving part 20 of the first cavity 10 for adjusting the insertion depth of each first moving part 20.

Figure 4A:
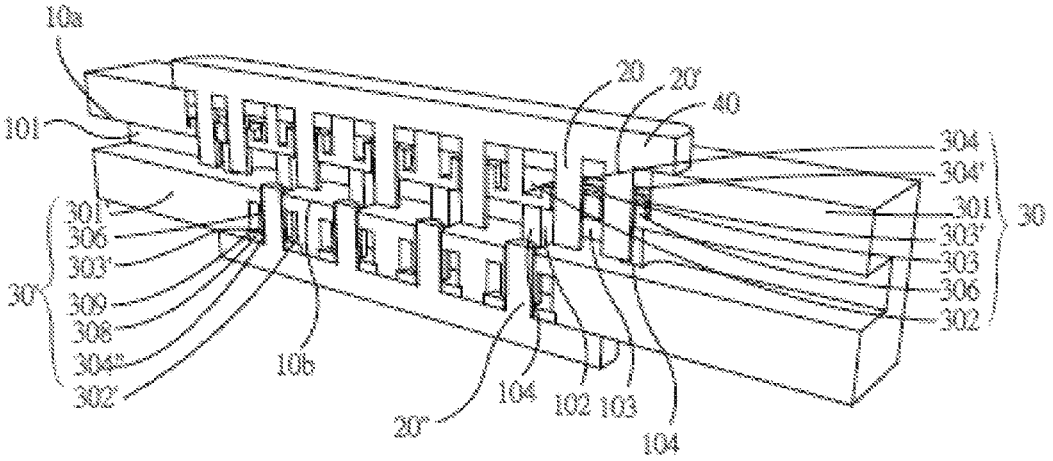
FIGS. 4A and 4B are an internal sectional view and an exploded view of a non-contact frequency automatic tuning filter with an antileakage chamber in accordance with another preferred embodiment of the present invention respectively.
Figure 4B:
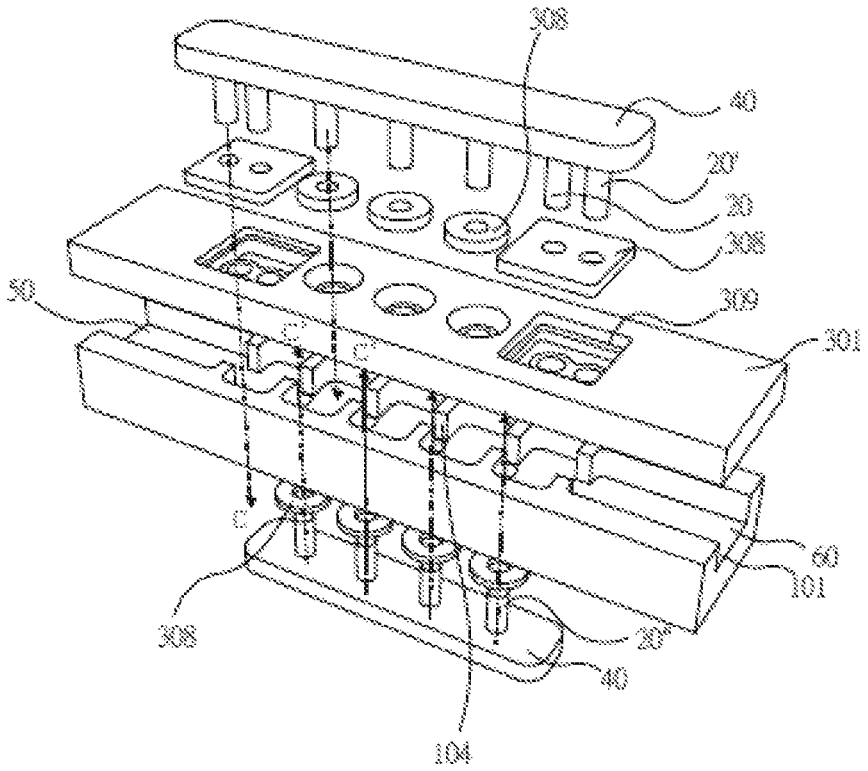

With reference to FIGS. 4A and 4B for the internal cross-sectional view and the exploded view of a non-contact frequency automatic tuning filter with an antileakage chamber in accordance with another preferred embodiment of the present invention respectively, the first casing 101 has a first part 10*a* and a second part 10*b* disposed opposite to each other. If the first casing 101 is in a circular shape or oval shape, the first part 10*a* and the second part 10*b* may be disposed on opposite sides of the circular shaped or oval shaped casing respectively. If the first casing 101 is a polyhedron, the first part 10*a* and the second part 10*b* may be disposed on two opposite sides of the polyhedron respectively. The second cavity 30 is disposed at the first part 10*a*, and the non-contact frequency automatic tuning filter with an antileakage chamber 1 further comprises a third moving part 20", a third casing 301' disposed at the second part 10*b*, a second chamber 302' formed in the third casing 301', and a third cavity 30' penetrating through a sixth opening 304" of the third casing 301', and the third moving part 20" and the sixth opening 304" are configured to be corresponsive to the first cavity channel 104 and provided for plugging the third moving part 20" in the insertion direction C' from the sixth opening 304" into the first cavity channel 104 or plugged from the sixth opening 304" into a space between the sixth opening 304" and the first cavity channel 104. It is noteworthy that the third cavity 30' may include a fourth opening 303' of the second cavity 30, a spacing portion 306, a cover 308 and/or a flange 309, and the third moving part 20" is not in contact with the first casing 101 and/or the third casing 301', and the third casing 301' and the first casing 101 are integrally formed, or the third casing 301' and the first casing 101 are assembled separately.

In addition, the first to third moving parts share a linking part 40, or the first to third moving parts may use different linking parts, or the present invention may adopt a combination of the above. The third moving part 20" may not be configured to be corresponsive to the middle first cavity channel 104 among a series of the first cavity channels 104, but it may be configured to be corresponsive to either the leftmost or rightmost first cavity channel 104 among a series of first cavity channels 104.

Figure 5:
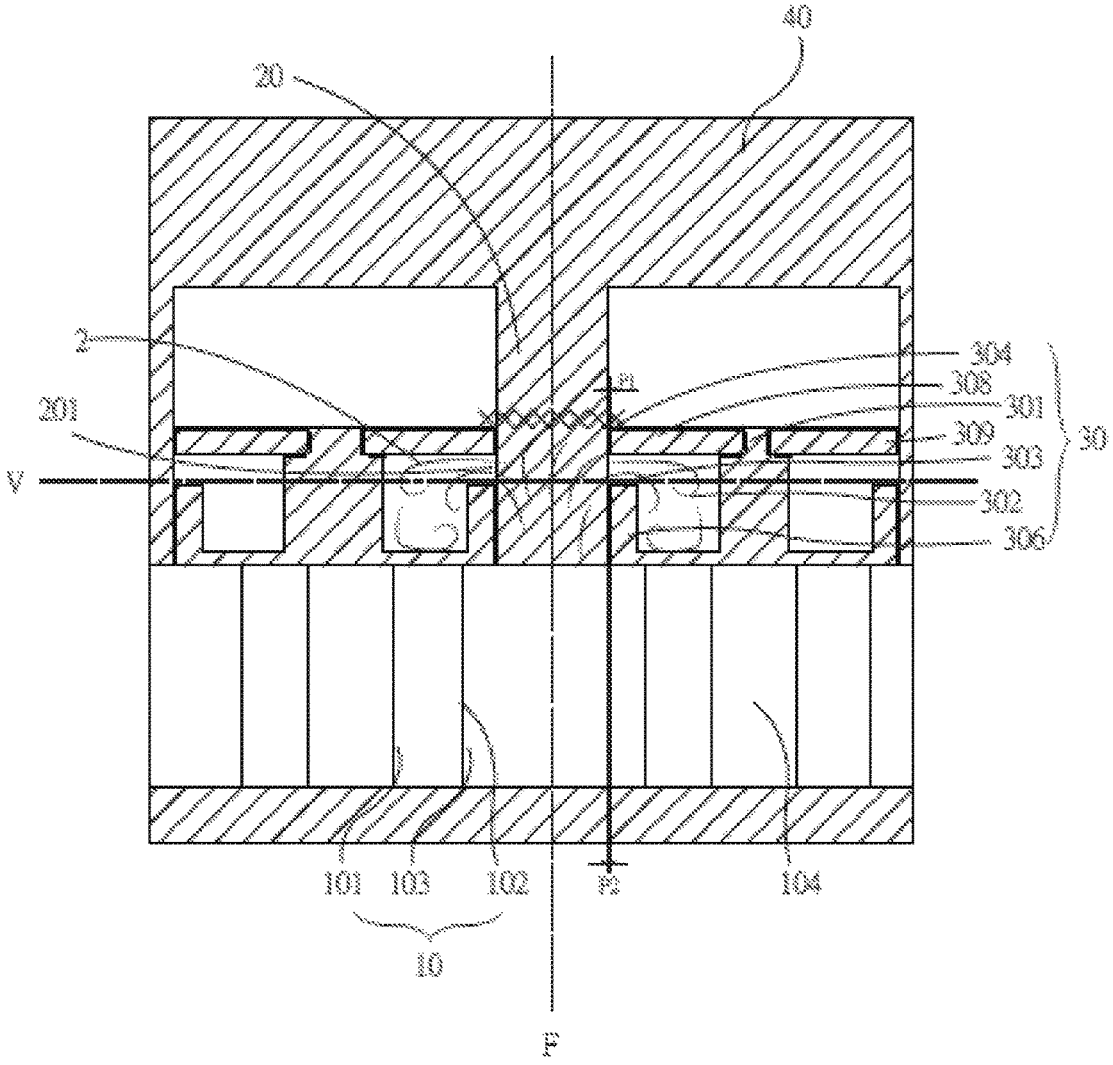
FIG. 5 is a schematic view of a non-contact frequency automatic tuning filter with an antileakage chamber in accordance with a preferred embodiment of the present invention with the effect of preventing the leakage of electromagnetic waves while the electromagnetic waves are being transmitted.

With reference to FIG. 5 for a schematic view of a non-contact frequency automatic tuning filter with an antileakage chamber in accordance with a preferred embodiment of the present invention having the effect of preventing the leakage of electromagnetic waves while the electromagnetic waves are being transmitted. When the electromagnetic waves are transmitted to the first cavity 10 plugged with the first moving part 20, the present invention with the second cavity 30 can prevent a large quantity of electromagnetic waves 2 from leaking from the first cavity 10 or dispersing from the space between to the first moving part 20 and the third opening 304 to the outside of the non-contact frequency automatic tuning filter with an antileakage chamber 1 by means of the spacing produced by the movement of the first moving part 20 (wherein the symbol X in FIG. 5 indicates the effect of preventing the leaked electromagnetic waves 2 from passing through), and a small quantity of leaked electromagnetic waves is transmitted through the second opening 303 to the second cavity 30 in order to maximize the effect of transmitting the electromagnetic waves correctly.

In summation of the description above, the present invention guides a smaller amount of leaked electromagnetic waves through the second opening 303 of the second cavity 302' into the chamber and provides a non-contact design of the first moving part 20 and the second casing 301, so that the non-contact frequency automatic tuning filter with an antileakage chamber of the present invention has the effects of preventing a large quantity of leaked electromagnetic waves from producing an unstable phenomenon during the process of shifting the center frequency of the filter.

While the invention has been described by means of specific embodiments, numerous modifications and variations could be made thereto by those skilled in the art without departing from the scope and spirit of the invention set forth in the claims.

What is claimed is:

1. A non-contact frequency automatic tuning filter with an antileakage chamber, comprising:

a first cavity, having a first casing and a first opening formed on the first casing;

a first moving part; and a second cavity, having a second casing, a first chamber formed in the second casing, and a second opening and a third opening penetrating through the second casing, and the first moving part being plugged from the third opening into the first cavity or plugged from the third opening into a space between the third opening and the first cavity, and a portion of the second casing proximate to the plugged first moving part being configured into the shape of the first moving part, and the second opening being proximate to the first moving part and constituting a part of the first chamber, and the second casing having a spacing portion disposed at a position proximate to the first moving part for separating the first moving part and the first chamber, and the first casing and the second casing being not in contact with the first moving part.

2. The non-contact frequency automatic tuning filter with an antileakage chamber according to claim 1, further comprising a driving unit for adjusting an insertion depth of the first moving part.

3. The non-contact frequency automatic tuning filter with an antileakage chamber according to claim 1, wherein the first cavity, the second cavity and the first moving part come with a plural quantity and at least two of the first cavities are communicated with each other.

4. The non-contact frequency automatic tuning filter with an antileakage chamber according to claim 3, further comprising a linking part coupled to each of the first moving part of the respective first cavity to adjust an insertion depth of each of the first moving part.

5. The non-contact frequency automatic tuning filter with an antileakage chamber according to claim 3, wherein each of the second cavities corresponding to different first cavities is not communicated with one another.

6. The non-contact frequency automatic tuning filter with an antileakage chamber according to claim 3, further comprising a second moving part and a fifth opening, and at least two of the first cavities are communicated with each other through a first cavity channel, and a total number of the first moving parts and the second moving parts is equal to a total number of the third openings and the fifth openings, and the second moving part and the fifth opening are configured to be corresponsive to the first cavity channel, and provided for the second moving part to be plugged from the fifth opening into the first cavity channel or plugged from the fifth opening into a space between the fifth opening and the first cavity channel.

7. The non-contact frequency automatic tuning filter with an antileakage chamber according to claim 3, wherein the first casing has a first part and a second part disposed opposite to each other, and the second cavity is disposed at the first part and further includes a third moving part, a third casing disposed at the second part, a second chamber formed in the third casing, and a third cavity penetrating through the sixth opening of the third casing, the third moving part and the sixth opening are configured to be corresponsive to the first cavity channel, and provided for the third moving part to be plugged from the sixth opening into the first cavity channel or plugged from the sixth opening into a space between the sixth opening and the first cavity channel.

8. The non-contact frequency automatic tuning filter with an antileakage chamber according to claim 1, wherein the non-contact frequency automatic tuning filter with an antileakage chamber achieves an automatic tuning of a center frequency or bandwidth of the filter by the first cavity and the first moving part of a different insertion depth.

* * * * *